United States Patent [19]

Ljung et al.

[11] 3,980,518

[45] Sept. 14, 1976

[54] DEVICE FOR LIQUID-TREATING A RUNNING FIBER WEB, INCLUDING AN ARC-SHAPED DUCT

[75] Inventors: Bernt Johan Ljung, Sundsbruk; Karl-Erik Lennart Svensson, Sundsvall, both of Sweden

[73] Assignee: Sunds Aktiebolag, Sundsvall, Sweden

[22] Filed: Mar. 4, 1975

[21] Appl. No.: 555,086

[30] Foreign Application Priority Data

Mar. 4, 1974 Sweden ..... 7402863

[52] U.S. Cl. ..... 162/302; 8/156; 162/303; 162/322; 162/336

[51] Int. Cl.[2] ..... D21F 1/08

[58] Field of Search ..... 162/203, 204, 208, 211, 162/212, 216, 302, 303, 308, 322, 336, 341, 380; 8/156; 210/217

[56] References Cited

UNITED STATES PATENTS

| | | | |
|---|---|---|---|
| 2,473,270 | 6/1949 | Adams | 162/336 X |
| 3,263,598 | 8/1966 | Sylla | 162/302 X |
| 3,564,631 | 2/1971 | Burling | 8/156 |

*Primary Examiner*—S. Leon Bashore
*Assistant Examiner*—Richard V. Fisher
*Attorney, Agent, or Firm*—Lerner, David, Littenberg & Samuel

[57] ABSTRACT

A device for carrying out liquid treatment of a fiber pulp suspension to form a running fiber web includes an arc-shaped duct having various portions. The first portion has a converging cross-section for compressing the fiber pulp suspension to form the fiber web. The second portion has a diverging cross-section for the expansion of the fiber web and includes a liquid-treatment zone. The third portion has a converging cross-section for compressing the fiber web. Along its length, the duct is defined inwardly by a rotary cylindrical screen member and radially outwardly by a stationary wall member.

17 Claims, 6 Drawing Figures

DEVICE FOR LIQUID-TREATING A RUNNING FIBER WEB, INCLUDING AN ARC-SHAPED DUCT

BACKGROUND OF THE INVENTION

With known roller pressers for liquid treating a running fiber web, which utilize a washing device, it is difficult to control the flow of the fiber pulp suspension and the addition of washing liquid. This difficulty is primarily due to the fact that the washing zone is not defined. Therefore, the resulting fiber web is heterogenous and, thus, canalized, which, in its turn, brings about a poor washing effect with a high risk of plug formation.

SUMMARY OF THE INVENTION

In the present application, these difficulties are eliminated by providing a method of dewatering and treatment liquid containing substance mixtures, preferably fiber pulp suspensions in which the fiber pulp suspension is passed through an arc-shaped duct, which is defined inwardly by a cylindrical rotary screen member and radially outwardly by an opposite stationary wall member of continuous extension, in such a manner, that the fiber pulp suspension during its passage through the duct is thickened and compressed in a first step, at which liquid is being passed out through the screen member, and thereafter is expanded in a second step while the treatment liquid is being supplied through the opposite stationary, continuously extending wall member, and thereafter again is thickened and compressed in a third step at which liquid passes out through the screen member.

The device for carrying out the method is substantially characterized by an arc-shaped duct, which in the direction of travel of the fiber pulp suspension comprises a first portion having a converging cross-section to thicken and compress the fiber pulp suspension, a second portion having a diverging cross-section for the expansion of the fiber pulp suspension and including an inlet for treatment liquid, preferably washing liquid, and a third portion, which like said first portion has a converging cross-section to thicken and compress the fiber pulp suspension, which duct is defined inwardly by a cylindrical screen member, preferably a screening drum (perforated roll) and radially outwardly by an opposite stationary wall member of continuous extension. The wall member, however, may be designed as two or more wall portions of adjacent relationship which are individually adjustable to and fixable at a desired distance to the screen member.

Although this invention will be described with respect to its preferred embodiments, it should be understood that many variations and modifications will be obvious to those skilled in the art, and it is preferred, therefore, that the scope of the invention be limited, not by the specific disclosure herein, but only by the appended claims.

DETAILED DESCRIPTION OF THE DRAWINGS

Figure 1:
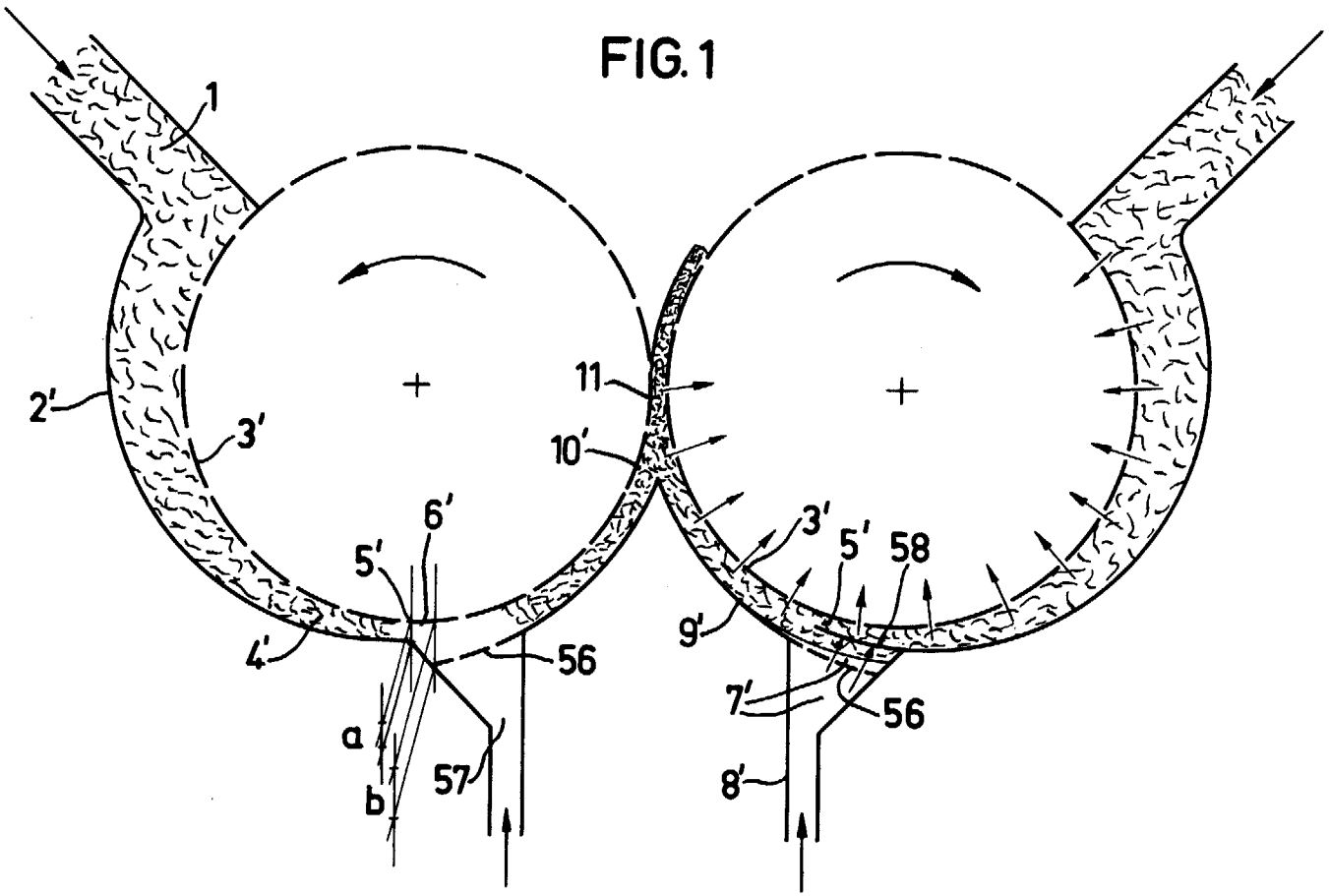
Figure 2:
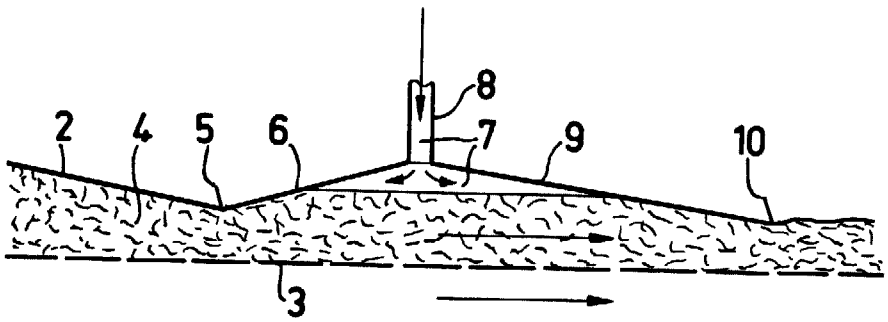
Figure 3:
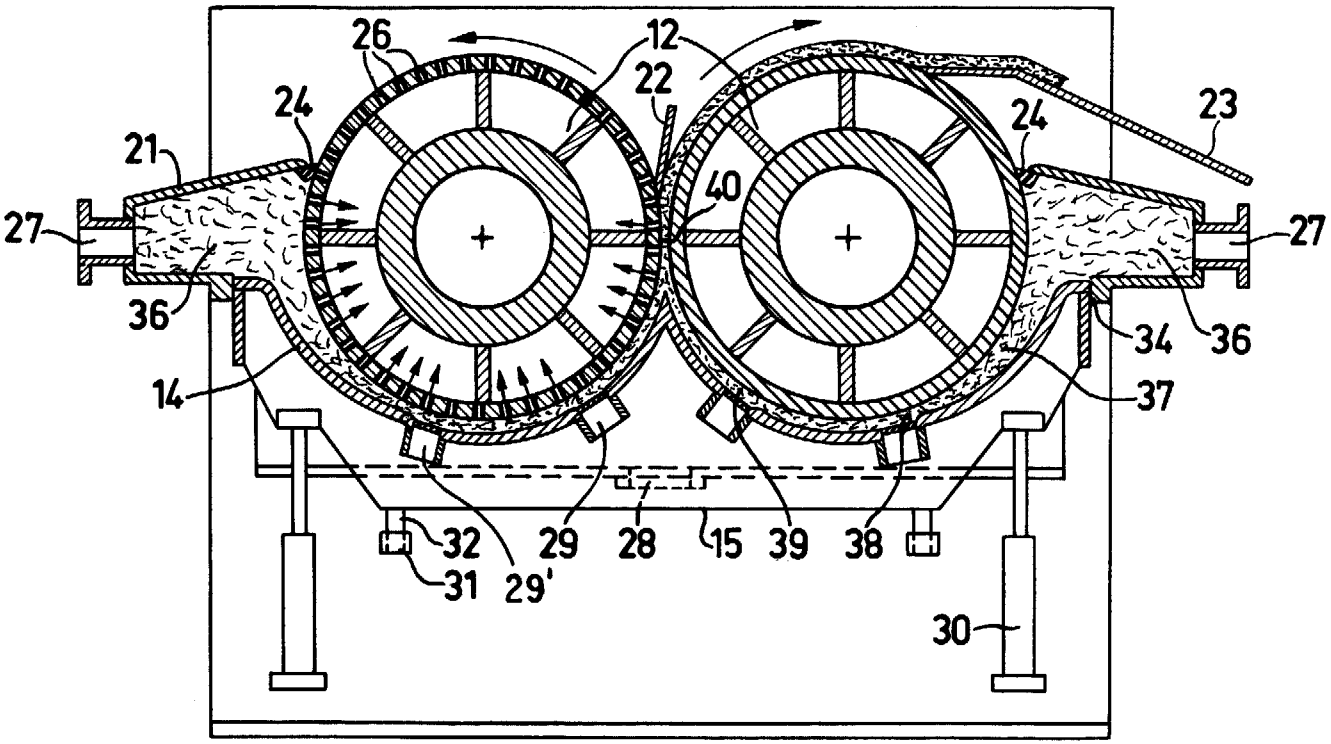
Figure 4:
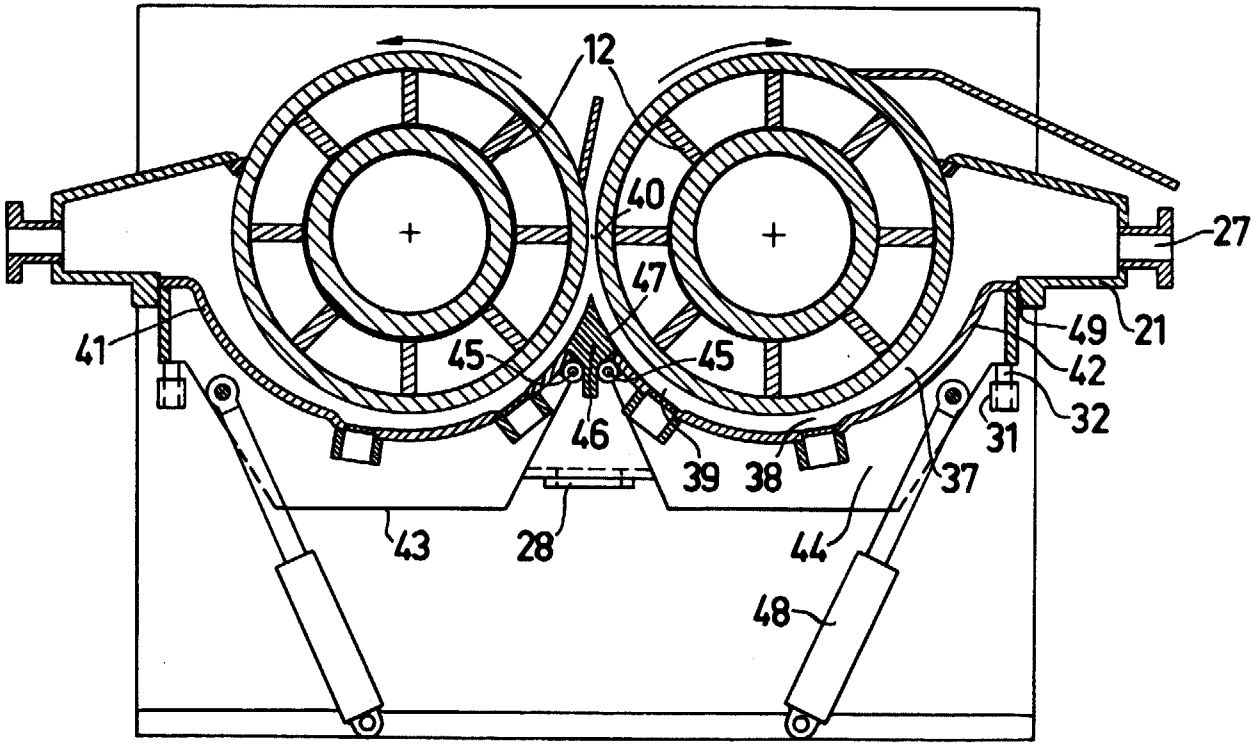
Figure 5:
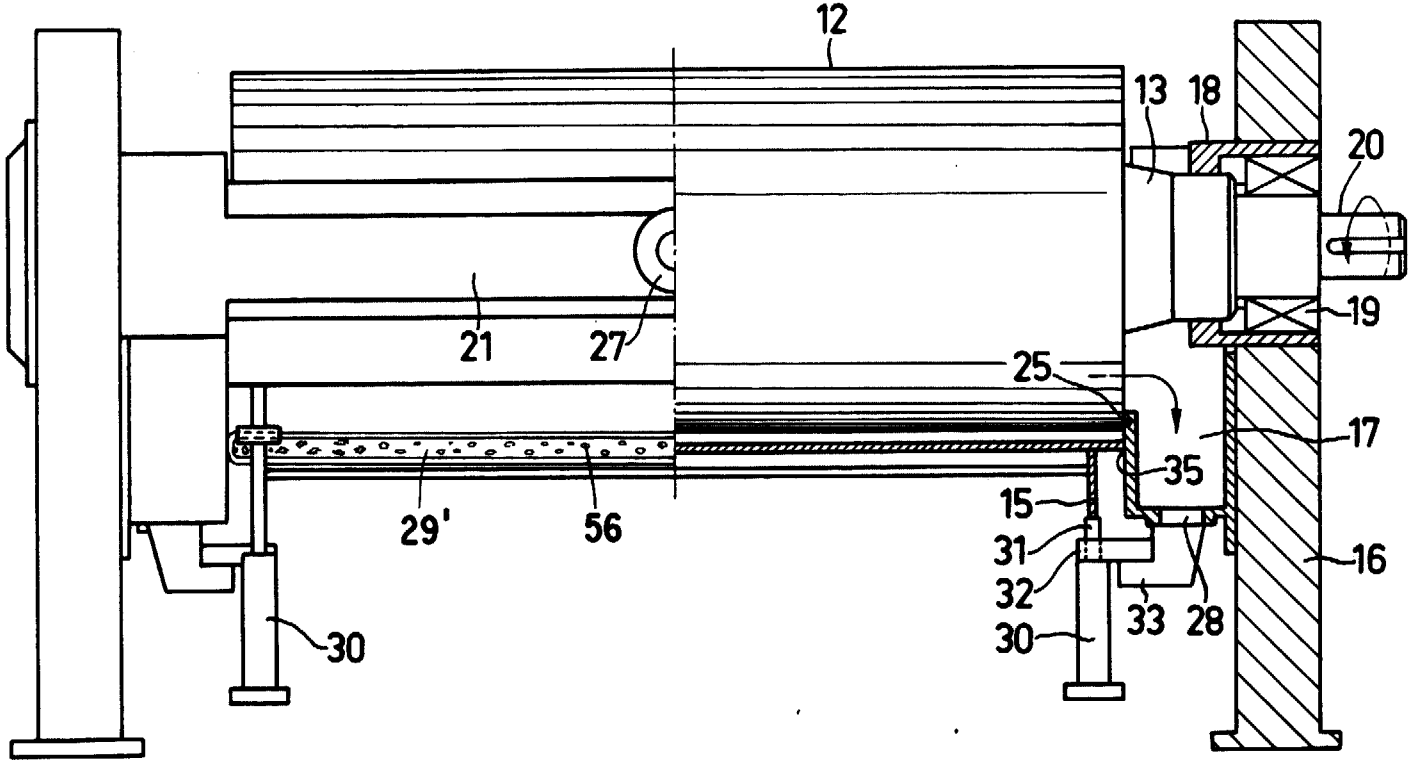
Figure 6:
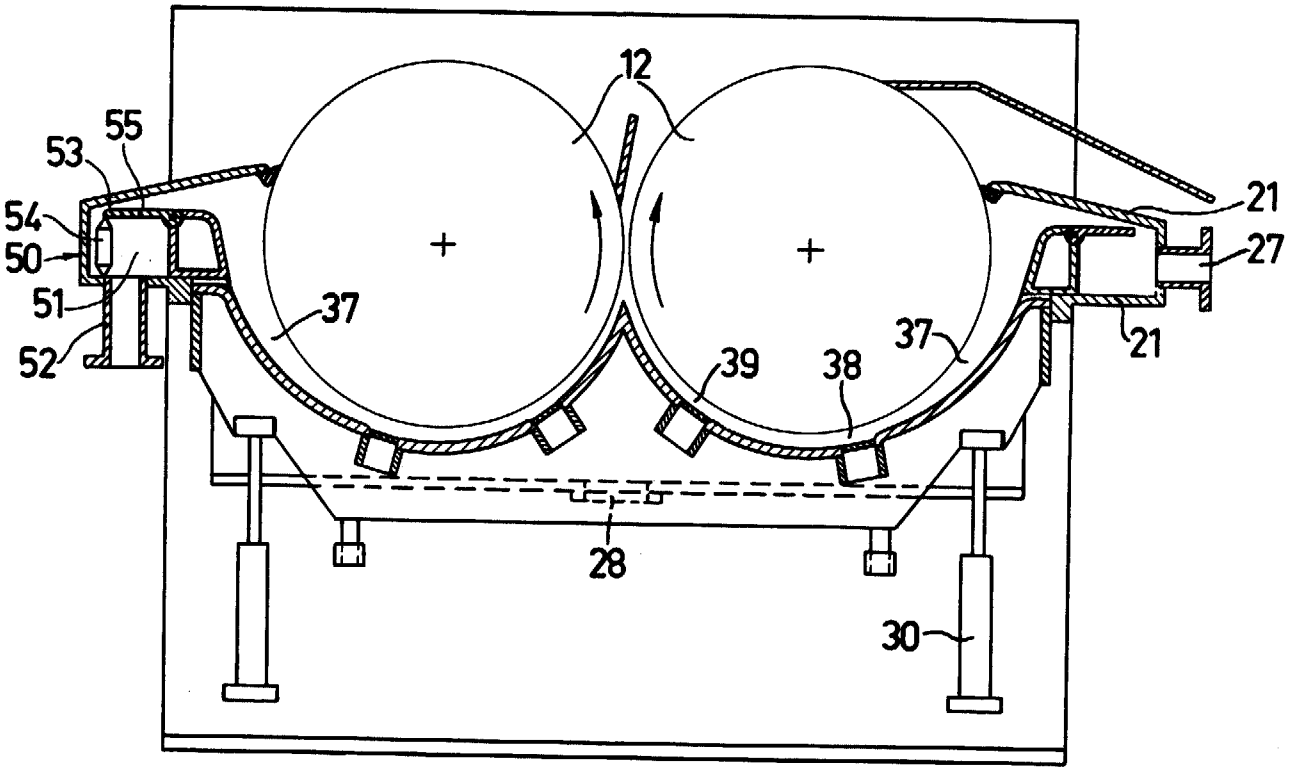

The method is apparent schematically from FIG. 2, and the device appears also schematically from FIG. 1 where it is shown applied to a so-called roller press of the kind comprising two press rollers separated by an intermediate space or nip, in which the material or fiber pulp web is additionally compressed or squeezed. FIGS. 3 and 4 show sectional views of embodiments of such roller presses, and FIG. 5 shows a lateral and sectional view taken between the rollers of the same presses. A suitable embodiment of the inlet to a roller press is shown in FIG. 6.

The basic prerequisites of the invention are explained in greater detail in connection with FIGS. 1 and 2. The fiber pulp suspension is supplied from an inlet 1 (not shown in FIG. 2) with a concentration of 1–6%, preferably 3–4%. The suspension is thereafter passed through the duct 2 (2'), which in the direction of travel of the suspension has converging cross-section, where thickening and compression take place. Liquid flows out through the screen member 3 (3') and, therefore, the fiber pulp suspension in the portion 4 (4') of the duct 2 (2') located closest to the outlet 5 (5') is compressed to a fiber mat or fiber web with a concentration of about 3–2 times the ingoing concentration, or to 3–12%. At 5 (5') the duct 2 (2') transforms into a duct 6 (6') having a diverging cross-section in the direction of travel of the fiber web. Treating liquid (washing liquid) 7 (7') is supplied to the duct 6 (6') through the inlet 8 (8') to compensate for the change in area and for displacement by the fiber web, entirely or partially, of the liquid following along from the duct 2 (2'), i.e., the liquid remaining after the dewatering through the screen member 3 (3'). The increase in area, according to the designations in FIG. 1, is *b:a*. A suitable value of this expansion ratio is 1.1:1 – 2.5:1. When the fiber web is permitted to expand more than 2.5:1, this may give rise to standing-still web portions or fiber clods, which may cause non-uniform displacement or washing and also can involve the risk of plugging the duct. Suitably an expansion ratio of about 1.5:1, but preferably of about 1.2:1, is to be chosen. Under certain conditions the expansion ratio may be chosen as low as about 1.05:1, i.e., the expansion is only 5%. The treatment or washing zone includes, in addition to the duct 6 (6'), which may also be called expansion zone, a compression zone 9 (9'), i.e., a duct which like the duct 2 (2') has converging cross-section. In this compression zone, the main part of the displacement through the fiber web takes place, and displaced liquid flows out through the screening portion 3 (3'). At the embodiment according to FIG. 1, the washing zone, which comprises the expansion zone 6 (6') and the compression zone 9 (9') terminating at 10 (10'), occupies less than one-fourth of the circumference of the roller or screen casing 3'. The said washing zone may also be about equal to one-fourth of the circumference of the roller or be somewhat larger.

The washing effects obtained were particularly good when the ingoing concentration to the first compression zone 2' was 3–4%, and the outgoing concentration from this zone was 6–8%. In the expansion zone 6 (6') a concentration gradient of 0–6 or 8%, and at 10' a concentration of 8–16% should be obtained. In the nip 11 (see FIG. 1) an additional increase in concentration to 34–45% usually to about 40%, is obtained.

The washing zone is defined against the first compression zone 2 (2') at 5 (5') and against subsequent means at 10 (10'). Hereby, the washing liquid will be mixed to a small degree with liquid in the fiber web of low concentration in the zone 2 (2'). An appreciable flow of washing liquid in the direction against the travel of the fiber web, thus, is prevented. The defined washing zone 6 (6'), 9 (9') further involves the advantage that the pressure in the washing zone can be controlled by the amount of washing liquid supplied, and the pressure in the washing zone will be substantially independent of the pressure conditions outside thereof.

A good washing effect can be obtained also at a relatively short expansion zone, if the washing liquid is added in such a manner, that it is mixed intensively with the fiber web at relatively high concentration, whereafter the fiber web is compressed to 25–60%.

In known roller presses with a washing device it is difficult to control the flow of the fiber pulp suspension and the addition of washing liquid. This difficulty is primarily due to the fact, that the washing zone is not defined, contrary to what is the case at the subject matter of this application. Therefore, the resulting fiber web is heterogenous and, thus, canalized, which in its turn brings about a poor washing effect with a high risk of plug formation. At the present application subject matter, these inconveniences are eliminated.

In FIG. 3 an end section of an embodiment of a roller press according to the invention is shown, and FIG. 5 shows a lateral view/lateral section of the same roller press. Two contrarotating rollers 12 are provided partially immersed into a trough, which comprises an upward and downward movable shell portion 14 and two end wall portions 15, which also are movable. The trough unit 14, 15 is sealingly connected to a stationary trough frame, which comprises two stand pieces 16, two drain boxes 17 for filtrate, four bearing housings 18 with bearings 19, which support the rollers 12 over axles 13. The rollers are driven by a drive means (not shown) connected to journals 20. For driving the rollers, preferably hydraulic motors with low number of revolutions are applied. Such a motor can be mounted directly on each of the two axle journals 20, thereby solving both the speed control and contrarotation of the rollers in a simple manner, the contrarotation being solved without the use of intermediate gearings. The hydraulic motors, which may also be arranged two on each roller, i.e., one on each side, are not shown in the drawings. To the stationary trough frame 16, 17, 18 are, further, connected a stationary trough upper structure 21, a doctor 22 and a doctor table 23 for diverting the fiber web.

The trough, which encloses the fiber pulp suspension/fiber web, is under overpressure, preferably 0.1–1.5 gauge pressure, and for this reason sealing strips 24 and 25 or the like are provided at the periphery of the rollers, and respectively, end walls of the rollers. The shell surfaces of the rollers may be perforated or slotted. The perforated embodiment is indicated schematically in FIG. 3 by means of holes 26. The trough frame and the stand frame are provided with necessary connections, viz, inlet 27 for the fiber pulp suspension, outlet 28 for outgoing filtrate from the dewatering and displacement zones, and inlet 29 for treatment liquid (washing liquid).

The aforementioned movement of the trough unit 14, 15 can be effected by means of a hydraulic, pneumatic or mechanic device, or a combination of such devices. In FIGS. 3 and 5 the firstmentioned device is shown, which comprises four hydraulic cylinders 30, the piston rods of which actuate the movable trough unit 14, 15. In upper position, the trough unit can be finely adjusted and locked by means of, for example, set screws 31 fastened in the movable trough unit, swingable arms 32 and stationary brackets 33 attached to the trough frame. The operation is as follows. When the trough unit after having been immersed is being moved upwards, each arm 32 is swung to a position perpendicular to the plane of the paper in FIG. 5. When the hydraulic cylinders 30 have moved the trough unit upwards to the desired level, the arm 32 is swung inwards over the bracket 33 so that the position shown in FIG. 5 is obtained. The arm 32 is thereafter locked by means of a stop nut or the like. When the height position of the trough unit is being finely adjusted, the trough unit preferably is held resting on the hydraulic cylinders, so that the set screws 31 are relieved of pressure. The trough unit is intended to rest during operation on the brackets 33 and seal around against the trough frame at sealing surfaces 34 (FIG. 3) and 35 (FIG. 5). The movability of the trough unit provides several advantages. The distance between the rollers and trough shell portions 14 can be adjusted and set so that optimum washing effect is obtained. The trough unit can, after plug formation or jamming therein, easily and effectively be cleaned in immersed position. The distance between the rollers and trough shell portions can be set with respect to output, pulp type, ingoing concentration, pulp temperature, etc.

The function at the application of the invention with roller presses has been described already with reference to FIG. 1, so that only brief additional information is required concerning the embodiment shown in FIGS. 3 and 5. The fiber pulp suspension is supplied to the roller press through inlets 27. A plurality of inlets are arranged on each side to ensure uniform supply to the inlet space 36. From this space, the fiber pulp suspension flows to the compression zone 37 and then in the form of a fiber web enters a first washing zone 38 and a second washing zone 39. Both washing zones comprise first a diverging and thereafter a converging cross-section in the direction of the fiber web travel. After the fiber web has left the second washing zone, additional dewatering and compression take place in the nip 40. The fiber web is thereafter led by means of the doctor 22 over one roller 12 and continuous flowing out from the roller press over the doctor table 23.

FIG. 4 shows an embodiment, which differs from the embodiment according to FIG. 3 only with respect to the adjustability of the trough unit. The shell portions 41 and 42 and the end wall portions 43 and 44 of the trough unit, instead of being movable, are pivotal about pins 45, which are supported on a beam 46 rigidly connected to the trough frame. The shell portions of the pivotal trough units 41 and 42 extend to the pins 45 where they transform to the side surfaces 47 of the stationary beam 46. The pivotal movement is effected by means of hydraulic cylinders 48, which are arranged in a manner analogous to that at the embodiment shown in FIG. 3. This applies also to the fine adjustment and locking in upper position of the trough unit by means of the set screws 31 and swingable arms 32. During operation, thus, the trough unit will rest on the brackets 33 (FIG. 5) and seal all around against the trough frame at the sealing surfaces 49 (FIG. 4) and 35 (FIG. 5).

FIG. 6 shows a particularly suitable inlet box 50 with inlet space 51 for uniform distribution of the fiber pulp suspension along the entire length of the rollers 12. The fiber pulp suspension is charged through the inlet socket 52, which may also be attached as a horizontal socket 27 on one longitudinal side of the inlet box, and alternatively, be located on the end portion of the inlet box for inflow in parallel with the axis line of the rollers 12. On the inlet box may be arranged one or more inlet sockets having the same inflow direction or different inflow directions according to the aforesaid alternative. The space 51 communicates with the compression zone 37 of the roller press by a narrow, preferably adjustable gap 53, through which the fiber pulp suspension passes with high speed. The resulting pressure drop over the gap promotes the uniform distribution of the fiber pulp suspension in the longitudinal direction of the rollers, because the pressure in the space 51 along the gap 53 can be maintained constant with small variations. The pressure drop may also be brought about by means of a row of holes (apertures) in the longitudinal direction of the gap, with a flow area corresponding to the gap area.

When the inlet socket 52, 27 is disposed on the end portion of the inlet box 51, 36, the box preferably is designed with reducing cross-section in the axial flow direction of the fiber pulp suspension.

The gap width may be 1–10 millimeters, depending on pulp type, ingoing concentration, capacity and other operation conditions. The gap shown in the drawing is directed substantially horizontally, but it may also have another direction, for example, substantially vertical. After the gap, the speed of the fiber pulp suspension should be reduced to about the same as the circumferential speed of the roller 12. The speed in the gap preferably is chosen to be about 5 m/s.

In order to compensate for different flow amounts and varying operation conditions, the gap width can be adjusted by setting means 54, in which connection the adjustable plate 55 defining the width of the gap 53 preferably is given a hinged design.

The essential characterizing features of the invention, thus, are that the wall member opposite to the screen member — instead of being movable in the direction to and from the roller — is disposed stationary, i.e., fixed, during operation, and that it extends continuously in the peripheral direction of the roller from the charging place of the fiber pulp suspension to the discharge place from the washing zone, or at the embodiment comprising several subsequent washing zones, to the discharge place from the last washing zone.

For uniform distribution of the treatment liquid, several inlets 8, 8' should be arranged in subsequent relationship in the axial direction of the roller. At the place where the liquid is being supplied, the wall member section opposite to the roller may be perforated by holes or slots 56, as appears from FIG. 1. The inlets 8' may be designed as a plurality of pipes with conical portions from 57 to 56, or as a passage 29, 29' extending in the axial direction of the roll. The area of the holes or slots may be chosen so that the speed of the treatment liquid through the apertures 56 is sufficiently high to give rise to the necessary pressure drop for effecting uniform distribution of the treatment liquid. The number of inlets may thereby be decreased to one single or a few for each supply zone (washing zone). The perforated wall member with apertures 56 has an extension in the axial direction of the roller which is substantially the same as the length of the roller. In order to avoid disturbance of the uniform displacement procedure, a shield 58 can be provided inside of the perforated portion 56. When, on the other hand, an intense mixture of washing liquid and fiber web, and as a result thereof a compression to high concentration of 25–60% are desired, the embodiment without shield must be chosen.

Although this invention has been described with respect to its preferred embodiments, it should be understood that many variations and modifications will now be obvious to those skilled in the art, and it is preferred, therefore, that the scope of the invention be limited, not by the specific disclosure herein, but only by the appended claims.

What is claimed:

1. A device for carrying out liquid treatment of a fiber pulp suspension to form a running fiber web, said device comprising an arc-shaped duct, said duct including a first duct portion having a converging cross-section for compressing the fiber pulp suspension to form the fiber web, a second duct portion having diverging cross-section for the expansion of the fiber web, said second portion including a supply line for introducing treatment liquid, and a third duct portion having a converging cross-section for compressing the fiber web, said duct being defined inwardly by a rotary cylindrical screen member and radially outwardly by a stationary wall member.

2. The device defined in claim 1 wherein said duct further includes other duct portions having diverging and converging cross-sections, respectively, said other duct portions being connected to said third duct portion and being in line therewith.

3. The device defined in claim 1, wherein said stationary wall member includes a perforated wall section in said second duct portion through which section said treatment liquid is supplied.

4. The device defined in claim 1 wherein said supply line is perpendicularly disposed to the direction of travel of the fiber web through said second duct portion.

5. The device defined in claim 1 wherein said supply line comprises a passage extending perpendicularly to the direction of travel of the fiber web through said second duct portion.

6. The device defined in claim 1 further comprising an inlet box for the duct, said box including means defining a space with at least one inlet line and outlet means, said space and said outlet means extending along substantially the entire axial length of the duct, and cooperating to cause a pressure drop resulting in uniform flow of said suspension along said outlet means.

7. The device of claim 6 wherein said outlet means comprises means defining a gap the width of said gap being sufficiently small to cause a pressure drop resulting in uniform flow of said suspension along said gap.

8. The device defined in claim 7, wherein the gap width is 1–10 mm.

9. The device defined in claim 7, including means for adjusting the gap width.

10. The device defined in claim 1 further comprising an inlet box for the duct, said box including means defining a space and means defining sockets on an end portion of said inlet box, said space having a cross-section decreasing in the axial flow direction of the fiber pulp suspension.

11. The device defined in claim 1 further comprising a second arc-shaped duct in opposed relationship to said arc-shaped duct, said second duct also including first, second, and third duct portions having converging, diverging, and converging cross-sections, respectively, said second duct portion also including a supply line for introducing treatment liquid, said second duct being defined inwardly by a second rotary cylindrical screen member and radially outwardly by a second stationary wall member, said cylinder and said second cylinder being arranged to define a nip therebetween.

12. The device defined in claim 11 wherein said stationary wall members comprise shell portions, and said device further includes end wall portions and means for adjusting and means for locking said shell portions relative to said cylinders.

13. The device defined in claim 12 further including means for moving said shell portions and means for moving said end wall portions rectilinearly to and from said cylinders, and means for locking said shell portions and means for locking said end wall portions relative to said cylinders.

14. The device defined in claim 13 wherein each of said means for moving are hydraulic cylinders.

15. The device defined in claim 12 further including means for pivoting said shell portions and means for pivoting said end wall portions relative to said cylinders and means for locking said shell portions and means for locking said end wall portions relative to said cylinders.

16. The device defined in claim 15 wherein said means for pivoting include pins about which said end wall portions are pivotal, said pins being supported on a beam provided beneath the nip and extending the axial direction of said cylinders.

17. The device defined in claim 16 wherein said means for pivoting comprise hydraulic cylinders.

* * * * *